US006620040B2

(12) United States Patent
Rehbein et al.

(10) Patent No.: US 6,620,040 B2
(45) Date of Patent: Sep. 16, 2003

(54) MOISTURE VENTING STRUCTURE FOR THE CONSTRUCTION OF WALLS

(76) Inventors: Daniel F. Rehbein, 18610 Alamo St., Wyoming, MN (US) 55092; David C. Larson, 5832 Louis Ave., Minnetonka, MN (US) 55345

( * ) Notice: Subject to any disclaimer, the term of this patent is extended or adjusted under 35 U.S.C. 154(b) by 0 days.

(21) Appl. No.: 10/039,802

(22) Filed: Jan. 4, 2002

(65) Prior Publication Data

US 2003/0129940 A1 Jul. 10, 2003

(51) Int. Cl.[7] ..... F24F 7/00
(52) U.S. Cl. ..... 454/185; 454/276; 454/250
(58) Field of Search ..... 454/276, 185, 454/186, 237, 250; 52/198

(56) References Cited

U.S. PATENT DOCUMENTS 2,601,905 A * 7/1952 Anderegg ..... 96/144
2,864,251 A * 12/1958 Imbrogno et al. ..... 52/236.6
3,257,930 A * 6/1966 Averna ..... 454/185
3,543,458 A * 12/1970 Guritz ..... 52/127.3
4,295,415 A * 10/1981 Schneider, Jr. ..... 454/185
4,393,633 A * 7/1983 Charniga ..... 52/302.3
4,887,521 A * 12/1989 Miettinen ..... 454/185
5,761,864 A * 6/1998 Nonoshita ..... 52/302.3

* cited by examiner

*Primary Examiner*—Derek Boles
(74) *Attorney, Agent, or Firm*—Nawrocki, Rooney & Sivertson, P.A.

(57) ABSTRACT

The present invention provides a moisture venting structure for use in the construction of walls. It comprises a sheet of wall construction material. The sheet of material has a first side and a second side, wherein the first side has a plurality of channels formed therein. The channels are constructed and arranged to interconnect at least one channel with another channel. The interconnected arrangement, thereby, allows moisture to move from one channel into another channel.

15 Claims, 4 Drawing Sheets

MOISTURE VENTING STRUCTURE FOR THE CONSTRUCTION OF WALLS

BACKGROUND OF THE INVENTION

The present invention relates generally to the field of construction. In particular, the present invention relates to construction materials for the construction of walls.

The present invention addresses these needs, as well as other problems associated with coupling devices. The present invention offers advantages over the prior art and solves problems associated therewith.

Wall structures in many buildings are comprised of a space between the inner wall, forming a portion of a room, and the outer wall of a building. This space is typically provided for the purpose of placing insulation therein. However, it has become known that this structure, although providing a good position for the placement of insulation, provides a space for the condensation of moisture. This condensation is formed by the temperature difference between the interior temperature of the building and the exterior temperature. The condensation produces several problems including reduction in the insulative ability of the insulation due to freezing of the moisture, molding and rotting of the insulation, and the like.

Devices have been developed in attempts to resolve this problem. For example, it has been proposed to encapsulate the insulation with a barrier layer. The barrier layer has at least one side comprised of a corrugated material to be placed between the inner wall layer and the insulation layer to provide a space for the condensation to occur. The corrugated material was typically fabricated having a plurality of parallel grooves therein that allowed the moisture to drain down the layer and air flow to move upward through the structure. However, this design adds an additional part to the construction process and additional cost in the raw materials required. Furthermore, since the grooves are parallel, the design does not allow for the movement of air in non-parallel directions.

This becomes a problem when one portion of the wall does not receive sufficient air flow from the exterior of the wall and thereby freezing, molding, or rotting can occur in these spaces. This may occur when the grooves have been clogged by debris or when the grooves are obstructed because of the design of the structure.

Another design proposed the placement of a plurality of sheets of material within the wall each having channels formed therein. In this example, one material has parallel channels aligned horizontally and the other material has parallel channels aligned vertically. The channels are formed such that the vertical and horizontal sets of channels do not allow for communication of air or moisture between them. Therefore, although this design does provide additional ventilation as compared with the previous design, it still adds parts to the structure and does not allow for communication of the venting air to non-parallel areas of the wall structure.

SUMMARY OF THE INVENTION

The present invention provides a moisture venting structure for use in construction. It comprises a specially designed sheet of construction material, typically utilized as either the interior or exterior portion of a wall.

The sheet of material has a first side and a second side, wherein the first side has a plurality of channels formed therein. The first side is utilized to form a cavity having space for the placement of insulation. The channels provide a plenum for the movement of air for the purpose of venting the structure. The second side is utilized as the wall surface of an interior room or the exterior of a building and, thereby, may be planar and substantially free of indentations.

The channels are constructed and arranged to interconnect at least one channel with another channel. The interconnected arrangement, thereby, allows moisture to move from one channel into another channel. Preferably, each channel of the plurality of channels is interconnected with at least one other channel, thereby facilitating the venting of air from a single channel into every other channel. The preferred arrangement of the channels is at an angle of 45 degrees to each other.

The device may be combined with a vent channel assembly that is mounted to the base edge of the sheet. The vent channel thereby allowing air to communicate between the vent channel and a plurality of the channels formed in the sheet. The vent channel provides controlled access of air to and from the outside of the structure. One preferred design of the vent channel is through use of a j-channel structure. The vent channel may also be formed from a plurality of j-channels connected in series.

The channels formed in the sheet of material can be of any depth and width, however, they should not extend through the sheet. One suitable configuration for the channels provides a depth of ⅛" and a width of ⅝". The sheet itself may be constructed from any suitable building material. Two such examples of suitable building materials are plywood and oriented strand board (OSB).

The above mentioned benefits and other benefits of the invention will become clear from the following description by reference to the accompanying drawings.

DESCRIPTION OF THE PREFERRED EMBODIMENT

The present invention provides a moisture venting structure for use in construction. It particular, the present invention provides a venting structure particularly useful in the fabrication of walls for buildings.

Figure 1:
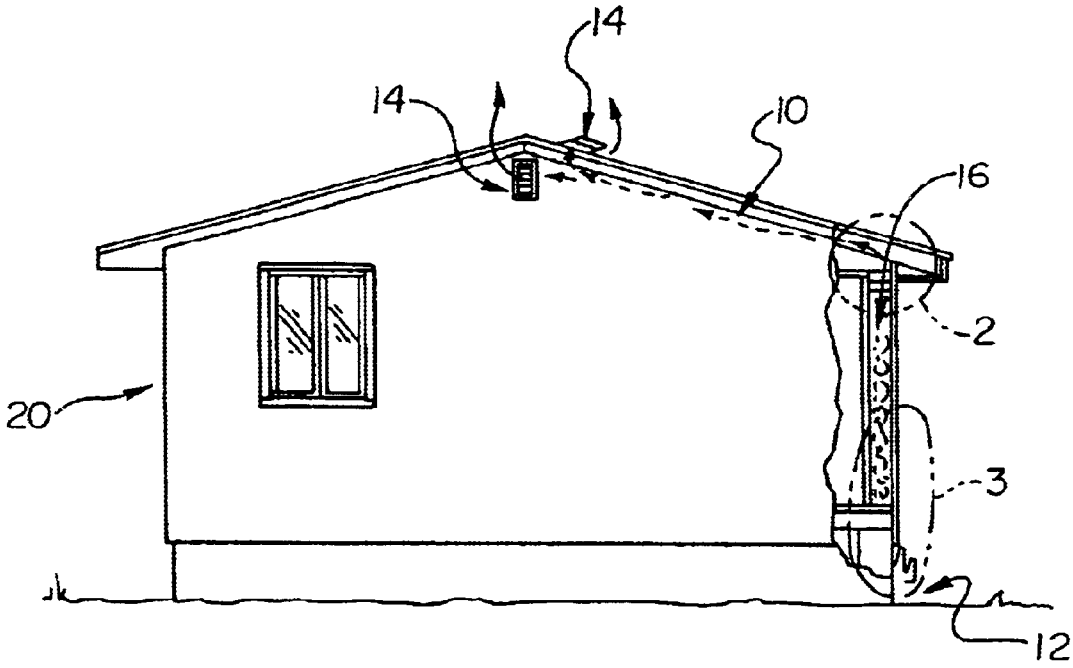
FIG. 1 is a side view of a building structure constructed according to the present invention.
Figure 2:
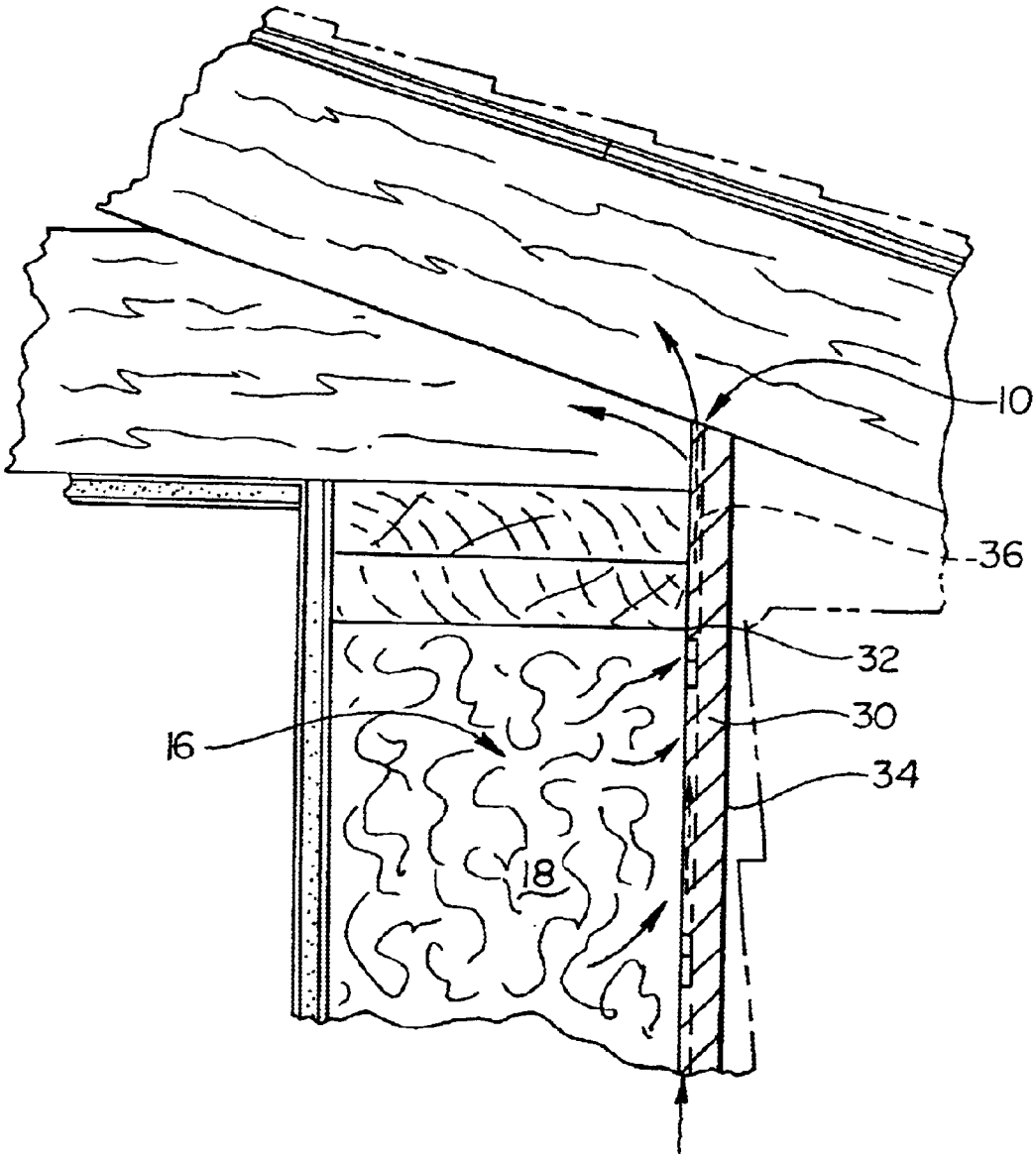
FIG. 2 is a close up cut away perspective view of a portion of the structure of FIG. 1.

FIG. 1 provides a perspective view of the side of a structure constructed according to the present invention. In this design, a flow channel 10 is constructed from near the bottom of the structure 20 to the top. At the bottom, an inlet 12 for air is provided. At the top, one or more outlets 14 are provided for venting the air outside the structure. The present invention is designed to provide a portion of the flow channel between the inlet 12 and the outlet 14.

Figure 4:
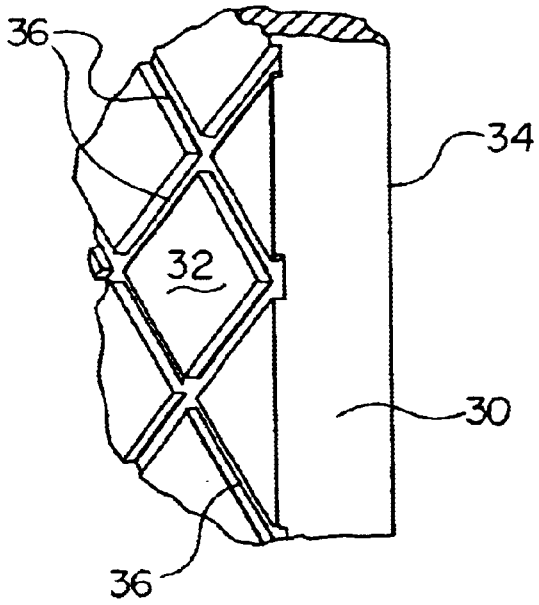
FIG. 4 is a segmented, angled side view of an embodiment of the present invention.

The present invention is comprised of a specially designed sheet of construction material. The sheet of material may be utilized as the interior or exterior wall of a building. As shown in FIG. 4, the sheet of material 30 has a first side 32 and a second side 34. The first side 32 has a plurality of channels 36 formed therein and is utilized to form a cavity 16 having space for the placement of insulation 18. Any known type of insulation in any form may be utilized with the present invention. Some typical examples of suitable insulation include fiber and foam and some forms of insulation include block and particle insulation.

A plenum for the movement of air for the purpose of venting the structure is provided by the channels 36 formed in the first side 32, wherein channels 36 allow air to flow through them despite abutment of the first surface 32 with the insulation layer 18. The second side 34 is utilized as the wall surface of an interior room or the exterior of a building and, therefore, this side 34 may have any surface structure suitable for use as an interior room or building exterior surface. Typically, for example, wall surfaces are planar and substantially free of indentations. This type of surface is preferable for painting and the mounting of wall treatments.

The channels 36 formed in the sheet 30 are constructed and arranged to intersect at least one channel 36 with another channel 36. The interconnected arrangement, thereby, allows moisture to move from one channel into another channel. This structure enables air to move more easily from one area of the cavity 16 to another area and thereby enables better, more thorough venting of the complete structure 20.

Preferably, each channel 36 of the plurality of channels is interconnected with at least one other channel 36, thereby facilitating the venting of air from a single channel into every other channel. This arrangement allows for further improvements in the venting of the overall cavity 16. Although any angled relationship between two channels may be utilized, a preferred arrangement of the channels is at an angle of 45 degrees to each other. This arrangement is shown in FIG. 4.

The sheet may be combined with a vent channel assembly that is mounted to the base edge of the sheet. The vent channel facilitates the communication of air between the vent channel and a plurality of the channels formed in the sheet. In this way, the vent channel provides controlled access of air to and from the outside of the structure.

The vent channel may also be designed to reduce the likelihood that the access to the venting structure will be obstructed. For example, the opening of the vent channel to the outside may be angled to prevent ice buildup over the opening or a screen may be placed over the opening to restrict access to animals or debris such as leaves and grass.

Figure 3:
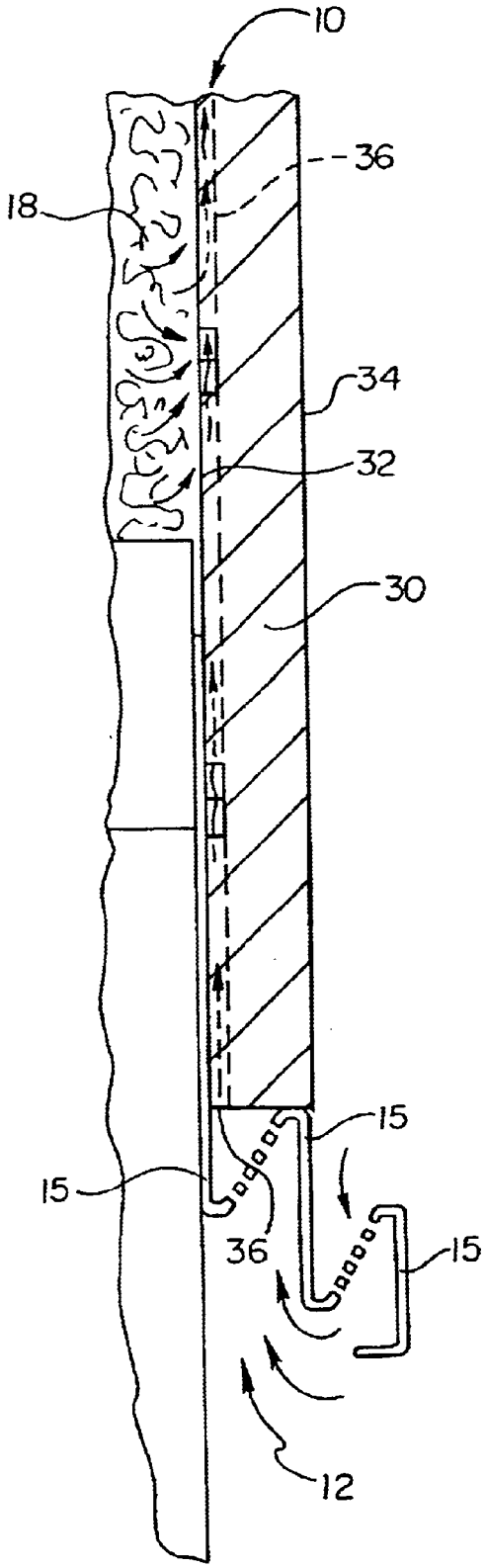
FIG. 3 is a close up cut away perspective view of a portion of the embodiment of FIG. 1.
Figure 5:
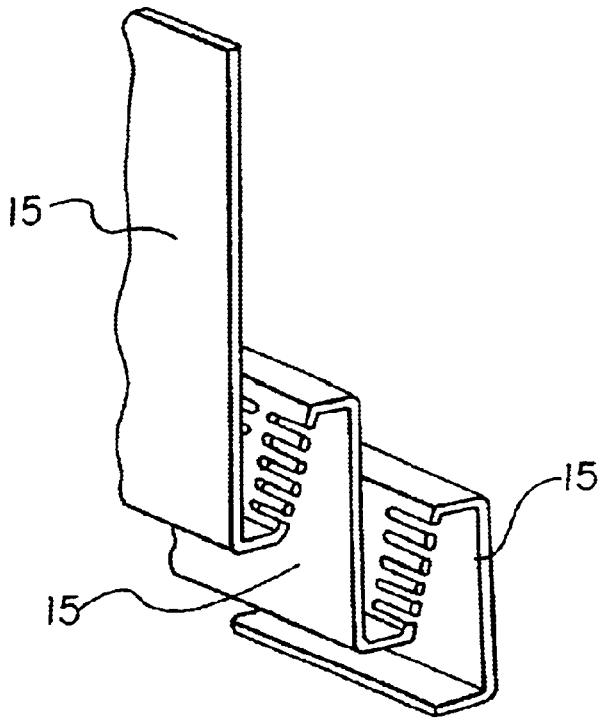
FIG. 5 is a segmented angled side view of a plurality of J-channels that are arranged in series.

One preferred design of the vent channel is through use of a j-channel structure. As shown in FIGS. 1, 3, and 5, the vent channel may also be formed from a plurality of j-channels 15 connected in series. This construction may allow the opening to be positioned in a downward direction, thereby reducing the possibility of ice forming over the opening.

The sheet itself may be constructed from any suitable building material. Two such suitable building materials are plywood and oriented strand board (OSB). The channels formed in the sheet of material can be of any depth and width, however, they should not extend through the sheet. One suitable configuration for the channels provides a uniform depth of all channels of ⅛" and a uniform width of all channels of ⅝". These dimensions would be suitable, for example, for use with plywood or OSB materials.

Although the present invention has been described with reference to preferred embodiments, workers skilled in the art will recognize that changes may be made in form and detail without departing from the spirit and scope of the invention. Additionally, since many possible embodiments may be made of the present invention without departing from the scope thereof, it is to be understood that all matter herein set forth or shown in the accompanying drawings is to be interpreted in the illustrative and not a limiting sense.

That which is claimed is:

1. A moisture venting structure for use in construction, comprising:

a sheet of material defining a wall of a plenum to be vented of moisture, said sheet having a first side facing the plenum, said first side having a plurality of channels, each of said plurality of channels defining a recess in said first side, said channels constructed and arranged such that one channel intersects another channel to create an interconnected arrangement which allows moisture to be vented to move from one channel into another channel.

2. A structure according to claim 1, wherein each said channel of said plurality of channels is interconnected with at least one other channel.

3. A structure according to claim 1, wherein two of said channels are at an angle of 45 degrees to each other.

4. A structure according to claim 1, wherein said sheet has a base edge and wherein a vent channel assembly is mounted thereto, such that air can communicate between said vent channel and a plurality of said channels formed in said sheet.

5. A structure according to claim 4, wherein said vent channel is a j-channel structure.

6. A structure according to claim 4, wherein said vent channel is formed from at least a plurality of j-channels connected in series.

7. A structure according to claim 4, wherein said vent channel has an opening for the transfer of air to and from the plenum and wherein a screen is positioned within said opening.

8. A structure according to claim 1, wherein said channels are ⅛" deep and ⅝" wide.

9. A structure according to claim 1, wherein said construction material is plywood.

10. A structure according to claim 1, wherein said construction material is oriented strand board.

11. A structure according to claim 1, wherein said second side of said sheet of material is substantially free of indentations.

12. A structure according to claim 11, wherein said sheet of construction material is a substantially planar sheet.

13. A structure for venting moisture from an insulation space within a building wall, comprising:

a sheet of material having a first side and a second side, said first side being generally planar and being constructed and arranged to face the insulation space and having a plurality of channels, each of said plurality of channels forming a recess within said first side, said channels constructed and arranged wherein at least one channel intersects another channel, such an interconnected arrangement allowing moisture to move from one channel into another channel and move away from the insulation space.

14. A moisture venting structure for abutment against an insulation layer received within a cavity in a wall of a building, comprising:

a sheet of wall construction material having a first side and a second side, wherein said first side has a plurality of channels, each of said plurality of channels forming a recess within said first side, said channels constructed and arranged to interconnect such that at least one channel intersects another channel, wherein said interconnected arrangement allows moisture to move from one channel into another intersecting channel, said first side of said material being constructed and arranged for positioning against a surface of an insulation layer to facilitate the removal of moisture from said insulation layer and said cavity.

15. A structure according to claim 13, wherein said sheet of material is constructed and arranged to be utilized as a wall forming a portion of said cavity in which said insulation is contained.

* * * * *